United States Patent [19]

Carlson et al.

[11] Patent Number: 4,926,523

[45] Date of Patent: May 22, 1990

[54] DOOR HANDLE OF A HOUSEHOLD REFRIGERATOR

[75] Inventors: James R. Carlson; Joseph D. Tobbe, both of Louisville, Ky.

[73] Assignee: General Electric Company, Louisville, Ky.

[21] Appl. No.: 375,571

[22] Filed: Jul. 3, 1989

[51] Int. Cl.[5] ..... E05B 1/00; A47B 95/02; B65D 25/28

[52] U.S. Cl. ..... 16/125

[58] Field of Search ..... 16/110 R, 111 R, 125

[56] References Cited

U.S. PATENT DOCUMENTS

| | | | |
|---|---|---|---|
| 3,393,423 | 7/1968 | Adams | 16/125 |
| 3,648,411 | 3/1972 | Saunders et al. | 49/460 |
| 3,766,598 | 10/1973 | Roberts | 16/125 |
| 3,977,054 | 8/1976 | Moore et al. | 24/265 R |
| 3,995,349 | 12/1976 | Roberts et al. | 16/125 |
| 4,016,315 | 4/1977 | Szabo | 428/68 |
| 4,047,263 | 9/1977 | Tietze | 16/125 |
| 4,087,141 | 5/1978 | Roberts | 312/320 |
| 4,713,860 | 12/1987 | Mobley et al. | 16/111 R |
| 4,745,656 | 5/1988 | Revlett | 16/110 R |

*Primary Examiner*—Richard K. Seidel
*Assistant Examiner*—Carmine Cuda
*Attorney, Agent, or Firm*—Frederick P. Weidner; Radford M. Reams

[57] ABSTRACT

A door handle assembly of a household refrigerator having a stiffener member with an elongated body made of rigid metal in the shape of an upwardly open channel with spaced apart legs including a first section offset form a second section to act as the gripping section and having spaced apart fastener receiving apertures. The first section has a molded soft elastomeric covering on the outside with apertures in alignment with the apertures in the stiffener member. A first decorative trim member having an outer and inner side with a contour to receive the legs of the channel of the first section of the stiffener member and including side walls overlapping the upper edge of the legs and elastomeric covering. The trim member has an open upwardly facing recess area in the outer side with apertures in alignment with the apertures in the stiffener member. There is an enlarged metal plate dimensioned to be nested in the recess area of the decorative trim member and having threaded fastener receiving apertures in alignment with the apertures in the decorative trim member and stiffener member. A second decorative trim member with an upwardly open channel surrounds the base and both legs of the channel of the second section and has one end secured to the decorative trim covering the first section and the other end secured to a trim end cap. A downwardly open channel shaped member is secured to the upwardly open channel of the second decorative trim member. Threaded fasteners pass through the apertures and threadedly engage the fastener receiving aperture in the elongated metal plate to rigidly assemble the components together as a subassembly for installation on a refrigerator door.

5 Claims, 2 Drawing Sheets

10
12
14
16
22
24
25
26
28
30
32
38
42
44
46
48
50
52
54
62
64
65
66
68
70
72
74
76
78
3
4
5

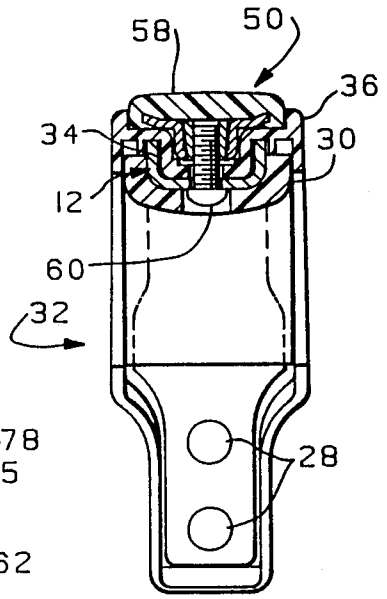
FIG. 5
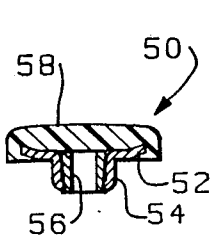
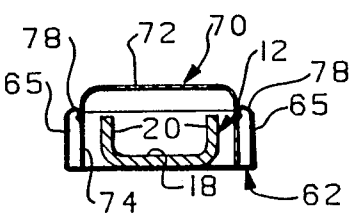
FIG. 8
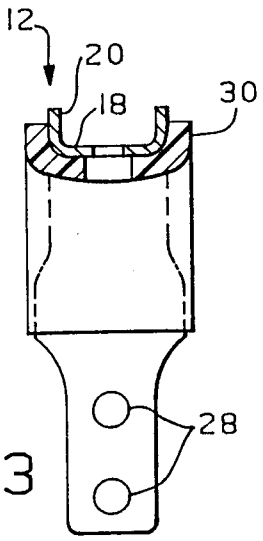
FIG. 3
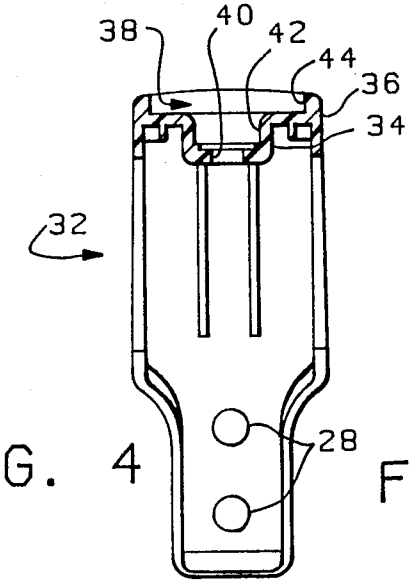
FIG. 4
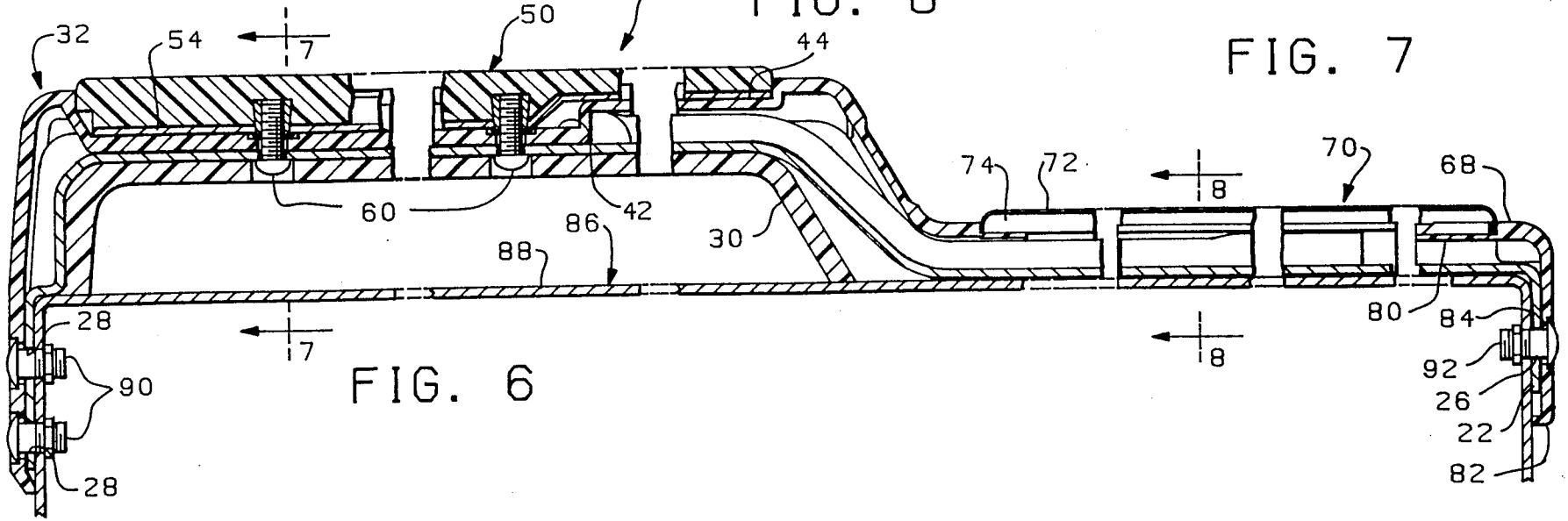
FIG. 7
FIG. 6

DOOR HANDLE OF A HOUSEHOLD REFRIGERATOR

BACKGROUND OF THE INVENTION

This invention relates to a front-mounted door handle assembly in general, but particularly to a door handle assembly such as for use with large appliances as refrigerators or combination two-door, top mount refrigerators as are quite common in the market today. Such refrigerator door handles are usually rather long and are mounted vertically to afford the user easy opening of the refrigerator doors. In a two-door refrigerator, each door would have to have its own door handle. Refrigerator doors are opened so frequently the door handles must be rugged in construction. It is desirable, however, to give the rugged door construction a "soft" feel to provide a comfortable grip for the user.

In the past, chromium-plated die castings were used for making strong door handles. However, recently the cost of such castings is exorbitant and therefore it is desirable that the non-critical structural parts utilize low cost material such as molded plastic that is chromium or aluminum plated to have the appearance of a shiny metal die casting.

In addition, for handles of this type they should be easily constructed and assembled with the fastening means hidden from view of the user for a pleasing appearance. The component elements of the handle should be capable of being assembled together with a minimum of fastener means, yet provide a solid rigid composite subassembly for attachment to the door of a refrigerator. The handle should also provide a comfortable grip for the user since it is used frequently to open and close the refrigerator doors.

SUMMARY OF THE INVENTION

The present invention relates to a door handle assembly of a household refrigerator and includes a stiffener member having an elongated body made of rigid metal in the shape of an upwardly open channel with a base and two legs and having a first section with fastener apertures therethrough and offset from a second section to provide a gripping section. The stiffener member has means at each end for securement to a refrigerator door. The first section has a molded soft elastomeric covering on the outside and apertures in alignment with the apertures in the stiffener member to receive fasteners therethrough. There is a first decorative trim member having an inner side with a contour to receive the legs of the channel of the first section of the stiffener member. The first decorative trim member has side walls overlapping the upper edge of the legs and elastomeric covering of the stiffener member, said trim member also having an open upwardly facing recess area in the outer side with fastener receiving apertures in alignment with the apertures in the stiffener member and also has a terminal end portion. An elongated metal plate is dimensioned to be nested in the recess area of the decorative trim member and has threaded fastener receiving means in alignment with the apertures in the decorative trim member and stiffener member.

A second decorative trim member with an upwardly open channel surrounds the base and both legs of the channel of the second section and has one end secured to the terminal end portion of the decorative trim covering the first section and the other end secured to a trim end cap that covers the means for securing the stiffener member to the refrigerator door. There is a downwardly open channel shaped member having a base and two legs, said legs being located between the legs of the upwardly open channel decorative trim member and the legs of the second section of the stiffener member.

Threaded fasteners pass through the apertures and threadedly engages the fastener receiving apertures in the elongated metal plate to rigidly assemble the components together as a subassembly for installation on a refrigerator door.

BRIEF DESCRIPTION OF THE DRAWINGS

FIG. 3 is taken along lines 3—3 of FIG. 2.

FIG. 4 is taken along lines 4—4 of FIG. 2.

FIG. 5 is taken along lines 5—5 of FIG. 2.

FIG. 6 is a cross-sectional view of the handle assembly of the present invention mounted on a refrigerator door.

FIG. 7 is taken along lines 7—7 of FIG. 6.

FIG. 8 is taken along lines 8—8 of FIG. 6.

DESCRIPTION OF THE PREFERRED EMBODIMENT

Figures 1, 2:
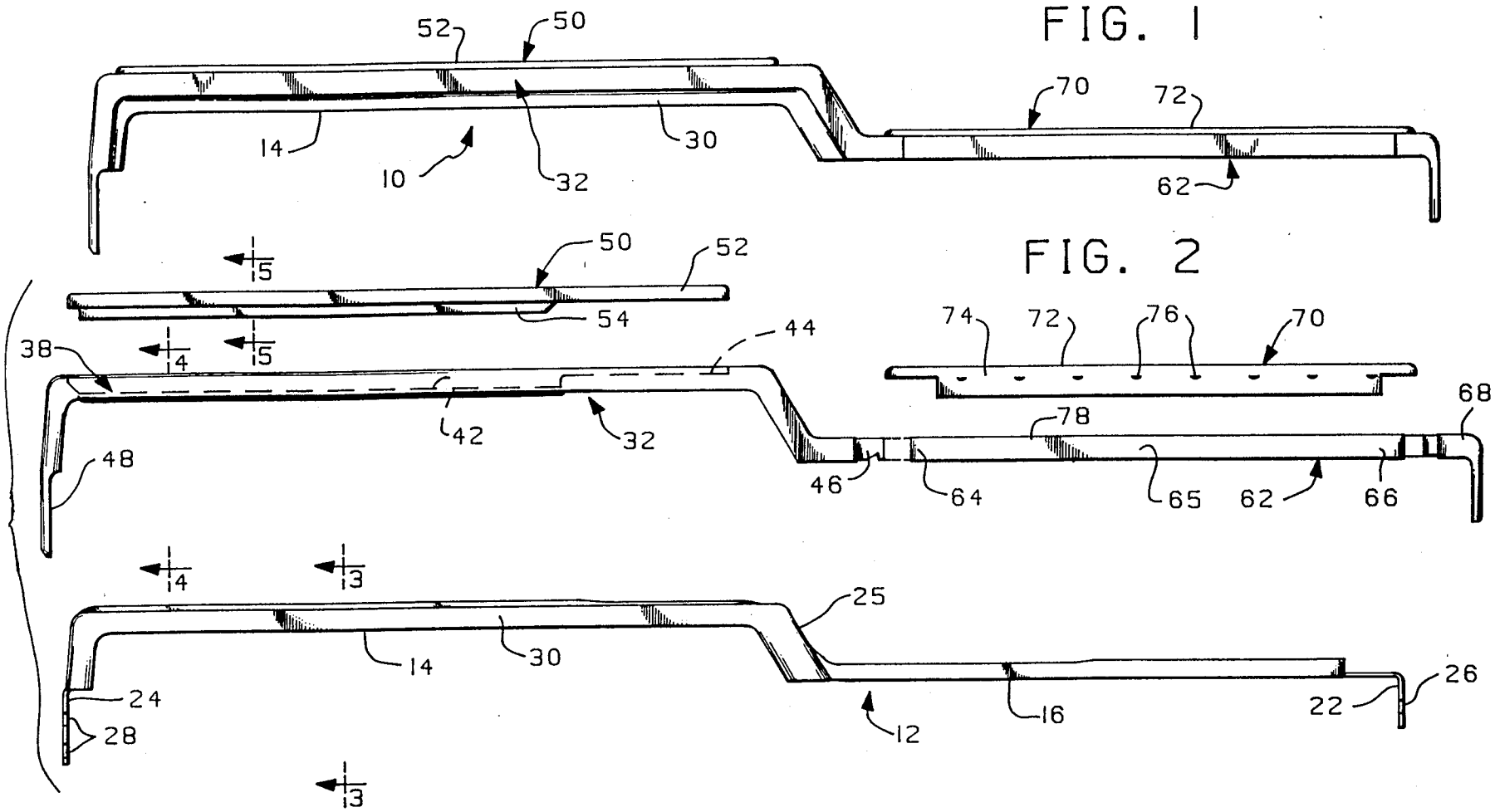
FIG. 1 is a side elevational view of the handle assembly of the present invention.
FIG. 2 is a side elevational view of the handle assembly of FIG. 1 showing the component members in an exploded view.

With reference to FIG. 1, the door handle assembly 10 of a household refrigerator is shown in its assembled condition so that it is a subassembly for attachment to an access door of a household refrigerator during the manufacture thereof. The door handle assembly 10 is a composite assembly of various independent members as shown in FIG. 2 where these members are separated from each other as they would be prior to assembly. There is a stiffener member 12 formed of relatively heavy gauge sheet metal and has a first section 14 offset from a second section 16 by an offset portion 25 to provide a gripping section. Both sections 14 and 16 are shaped as an upwardly open channel with a base 18 (FIG. 3) and two legs 20. The stiffener member 12 has means at each end for securement to a refrigerator door 86 (FIG. 6) and as shown in FIG. 2 there is one section 22 at one end of the stiffener member bent at a right angle to the elongated body of the stiffener member 12 and at the opposite end is section 24 also bent at a right angle to the elongated body of the stiffener member 12. Both of these end sections 22 and 24 have apertures 26 and 28 respectively through which fasteners pass for securing the handle assembly 10 to the door 86 as shown in FIG. 6.

It is desirable for user comfort that the handle section 14 have a "soft" feel when gripping the handle and for that purpose there is molded to the stiffener member 12 around the first section 14 a resilient rubber-like composition, such as microcellular water blown elastomer, referred to herein as a soft elastomeric covering 30. Both the stiffener member 12 and the elastomeric covering 30 have aligned fastener receiving apertures with one set of aligned apertures being near one end of section 14 and the other set near the opposite end of section 14 near the offset portion 25 separating the first section 14 from the second section 16.

The next member of the composite door handle assembly 10 is a first decorative trim member 32 which is usually molded from suitable plastic and metallized or plated to give the appearance of a chrome finished part. The inner side 34 (FIG. 4) has a contour to receive the legs 20 of the channel of the first section 14 of the stiffener member 12 and the side walls 36 overlap the upper edge of the legs 20 and the elastomeric covering 30 of the stiffener member 12. The trim member 32 has an open upwardly facing recess area 38 and fastener receiving apertures 40 in alignment with the apertures in the stiffener member 12. In the preferred embodiment the decorative trim member 32 has two recess areas, one smaller recess 42 inside the larger recess 44. The larger recess 44 is nearly coextensive with the length of the first section 14 of the stiffener member 12 whereas the smaller recess 42 is shorter in length. The first decorative trim member 32 extends down the inclined offset portion 25 and has a terminal end 46. The opposite end of the first decorative trim member 32 has a downwardly turned flange 48 which is at a right angle to the main body of the trim member 32. As shown in FIG. 2, the decorative flange 48 is to be placed over the section 24 of the stiffener member 12 and therefore has a shape that will receive that section. Accordingly, the flange 48 has fastener receiving apertures in alignment with the apertures 28 in section 24.

The next member of the handle assembly 10 is elongated metal plate 50 which is dimensioned to be nested in the recess area 38 of the decorative trim member 32 and has one section 52 coextensive with the larger recess 44 and a smaller section 54 which is coextensive with the smaller recess 42. The smaller section 54 has threaded fastener receiving apertures 56 which are in alignment with the apertures in the decorative trim member 32 and the stiffener member 12. In the preferred embodiment, section 52 of the elongated metal plate 50 has a soft elastomeric covering 58 adhered to it. The handle or gripping portion of the door handle assembly is assembled by placing the first decorative trim member 32 over section 14 of the stiffener member 12 and the elongated metal plate 50 in the recess area 38 of the trim member and then passing two headed threaded fasteners 60 (FIG. 6) through the soft elastomeric covering 30, the rigid first section 14 of the stiffener member 12, apertures 40 in the decorative trim member 32 and then threadingly engaging the threaded fastener receiving apertures 56 in the elongated metal plate 50. This then retains all of the component members together in a rigid structural manner with only two threaded fasteners being necessary.

To complete the door handle assembly 10 the second section 16 of the stiffener member 12 is surrounded by a second decorative trim member 62 which is in the shape of an upwardly open channel dimensioned to surround the base 18 and legs 20 of the channel of the second section 16. The second decorative trim member 62 is roll formed from suitable thin shiny metal sheet and is open at both ends. One end 64 of the second decorative trim member is secured as by telescoping it over the terminal end portion 46 of the first decorative trim member 32 in a close tolerance frictional fit manner and the opposite end 66 is secured to a trim end cap 68 which is L-shaped and conforms to the shape of the right angle section 22 of the stiffener member 12. The trim end cap 68 may be molded from suitable metallized plastic material and is also secured to end 66 by a close tolerance frictional fit.

Located above the second decorative trim member 62 is a downwardly open channel shaped member 70 which may be formed from relatively thin sheet metal. With reference to FIG. 8, the channel member 70 has a base 72 and two legs 74 and when assembled onto the second decorative trim member 62 the legs 74 are located between the legs 65 of the second decorative trim member 62 and the legs 20 of the second section of the stiffener member 12. The legs 74 have a series of spaced apart nibs 76 along the longitudinal length of the channel shaped member 70 which will engage the inwardly turned upper edges 78 of the legs 65 of the second decorative trim member 62 and will be retained in that position.

The end cap 68 which is L-shaped and has one end 80 inserted into the open end 66 of the second decorative trim member 62 in a close tolerance fit has the other end 82 overlying section 22 of the stiffener member 12 and has an aperture 84 in alignment with the aperture 26 of section 22 for receiving fasteners to secure the door handle assembly 10 to a refrigerator door 86.

The above description sets forth the components of the door handle assembly 10 and their method of attaching the components together to form a composite subassembly door handle which is then attached to a refrigerator door during the manufacture of the refrigerator. As shown in FIG. 6, the door handle assembly 10 is attached to a refrigerator door 86 through the outer metal shell 88 at the top of the door by two headed fasteners 90 and the opposite end is secured by headed fastener 92 to the bottom of the outer metal shell 88 of the door 86.

Modifications of this invention will occur to those skilled in the art; therefore, it is understood that this invention is not limited to the particular embodiments disclosed, but that it is intended to cover all modifications which are within the true spirit and scope of this invention as claimed.

What is claimed is:

1. A door handle assembly of a household refrigerator comprising:

a stiffener member having an elongated body made of rigid metal in the shape of an upwardly open channel with a base and two legs and having a first section offset from a second section to act as the gripping section and having spaced apart apertures, said stiffener member having means at each end for securement to a refrigerator door, said first section having a molded soft elastomeric covering on the outside and having apertures in alignment with the apertures in the stiffener member;

a first decorative trim member having an inner side with a contour to receive the legs of the channel of the first section of the stiffener member and side walls overlapping the upper edge of the legs and elastomeric covering, said trim member having an open upwardly facing recess area in the outer side with apertures in alignment with the apertures in the stiffener member and having a terminal end portion;

an elongated metal plate dimensioned to be nested in the recess area of the decorative trim member and having threaded fastener receiving means in alignment with the apertures in the decorative trim member and stiffener member;

a second decorative trim member with an upwardly open channel surrounding the base and both legs of the channel of the second section and having one end secured to the terminal end portion of the decorative trim covering the first section and the other end secured to a trim end cap secured to the means for securing the stiffener member to the refrigerator door;

a downwardly open channel shaped member having a base and two legs, said legs being located between the legs of the upwardly open channel decorative trim member and the legs of the second section of the stiffener member; and threaded fastener means through the apertures into the fastener receiving means in the elongated metal plate to rigidly assemble the components together as a subassembly for installation on a refrigerator door.

2. The door handle assembly of claim 1 wherein the decorative trim member has two recess areas one smaller and inside the other and the metal plate is dimensioned to be nested in both recess areas with the threaded fastener receiving means being located within the smaller recess area.

3. The door handle assembly of claim 1 wherein the first decorative trim member is molded from plastic material.

4. The door handle assembly of claim 1 wherein the elongated metal plate is substantially coextensive with the first section of the stiffener member and has a soft elastomeric covering.

5. The door handle assembly of claim 1 wherein the means at each end of the stiffener member for securement to a refrigerator door is a section bent at a right angle to the elongated body with apertures therethrough to receive fasteners.

* * * * *